US008240516B2

(12) United States Patent
Lautre

(10) Patent No.: US 8,240,516 B2
(45) Date of Patent: Aug. 14, 2012

(54) DEVICE FOR DISPENSING A LIQUID TO PASTY PRODUCT WITH A METERING PUMP

(75) Inventor: Philippe Lautre, Oyonnax (FR)

(73) Assignee: Plastohm SA, Oyonnax Cedex (FR)

( * ) Notice: Subject to any disclaimer, the term of this patent is extended or adjusted under 35 U.S.C. 154(b) by 473 days.

(21) Appl. No.: 12/597,038

(22) PCT Filed: Mar. 12, 2008

(86) PCT No.: PCT/FR2008/050421

§ 371 (c)(1),
(2), (4) Date: Oct. 22, 2009

(87) PCT Pub. No.: WO2008/142308

PCT Pub. Date: Nov. 27, 2008

(65) Prior Publication Data

US 2010/0116849 A1 May 13, 2010

(30) Foreign Application Priority Data

Apr. 24, 2007 (FR) ..... 07 02965

(51) Int. Cl.
*B67B 1/00* (2006.01)

(52) U.S. Cl. ..... 222/153.13; 222/209

(58) Field of Classification Search ..... 222/153.13, 222/153.14, 153.04, 206–211, 385, 386, 222/633

See application file for complete search history.

(56) References Cited

U.S. PATENT DOCUMENTS

| | | | | |
|---|---|---|---|---|
| 4,979,646 | A * | 12/1990 | Andris | 222/136 |
| 5,014,881 | A * | 5/1991 | Andris | 222/207 |
| 5,238,156 | A * | 8/1993 | Andris | 222/207 |
| 5,544,789 | A * | 8/1996 | Gillingham | 222/153.13 |
| 7,677,415 | B2 * | 3/2010 | Auer | 222/207 |
| 2012/0024904 | A1 * | 2/2012 | Doulin et al. | 222/207 |

FOREIGN PATENT DOCUMENTS

| | | | |
|---|---|---|---|
| DE | 8713891 | U1 | 2/1989 |
| EP | 0312722 | A1 | 4/1989 |
| NL | 7611290 | A | 5/1977 |
| WO | 2006031110 | A1 | 3/2006 |

OTHER PUBLICATIONS

International Search Report dated Oct. 23, 2008.

* cited by examiner

*Primary Examiner* — Lien Ngo
(74) *Attorney, Agent, or Firm* — Bachman & LaPointe, P.C.

(57) ABSTRACT

A device for dispensing a liquid to a pasty product is placed at the open end of a rigid container and includes a manual dosing pump for dosing a predetermined amount of product to be dispensed. The device has a base member to be placed on the container, a push button with a dispensing spout capable of a pumping action against a bellow including an opening-closing system formed at the upper end of the bellow. The opening-closing system includes a first inner peripheral collar formed at the upper end of the bellow and associated with a second collar of the bellow that is concentrically arranged relative to the first one and inserted in the same groove of the push button, wherein a locking tab capable of blocking the opening protrudes from the collar.

20 Claims, 13 Drawing Sheets

DEVICE FOR DISPENSING A LIQUID TO PASTY PRODUCT WITH A METERING PUMP

BACKGROUND (1) Field of the Invention

The present invention relates to a device for dispensing a liquid to pasty product intended to be installed on the open end of a rigid container and consisting of a metering system for dispensing a predetermined amount of product to be delivered.

(2) Prior Art

The first pumps were initially designed for perfumes with medical pumps subsequently being developed therefrom. These pumps have always emphasized the accuracy of the dose, product protection and repeatability.

As a result, with the efficiency of the pumps having taken precedence over the price, the number of components in a standard pump fluctuates between ten and fifteen depending on the model.

The use of such pumps was subsequently adopted for dispensing any liquid to pasty products, for example food products, cosmetic products, hygiene products, health products, beauty products or sun care products.

It was therefore the object to simplify the life of users by making it possible to obtain a dose by means of a simple movement.

However, as soon as the pumps were placed on markets with lower added value, such as food or cosmetics, hygiene, health and beauty, the price of the pumps acted as a brake.

Most of these new products using pumps are disposable products with a limited use life. Moreover, their requirements in terms of accuracy of dose and repeatability are more limited.

There are currently on the market a number of products having pumps, but many of these pumps represent an exaggerated response to users' expectations from the point of view of technical capabilities and costs.

This problem of cost has appeared recently with the spread of the products, which initially were top of the range, to the mass market.

It is for this reason that research has already been carried out into producing a pump dispensing system having few components, or at any rate as few as possible, in order to make it economical, and that numerous patents have been filed in this field describing pumps having for example five components: one component each for valve, base, push button, and deformable chamber.

However, while the aim of the first wave of simplified pumps was to reduce the costs of production, the aim of the second wave was to increase quality.

Thus, patent EP 0 312 722 presented a bellows pump solution making it possible to obtain an advantageous result with respect to customers' expectations, both from the point of view of cost, by virtue of a limited number of components, and from the point of view of metering accuracy and repeatability. This solution consisted in designing a pump comprising:

- a base element intended to be installed via its lower end on the container,
- a push button having a dispensing spout mounted telescopically on the upper part of the base element and capable of pump action with respect to the latter, against a return member consisting of
- an elastically deformable bellows for the sealed connection between firstly an internal chamber of the base element, which chamber is open toward the container in order for the product to pass through an opening, and secondly, at its upper end, an internal chamber of the push button into which a hole of the dispensing spout opens.

However, this abovementioned dispenser system has a major drawback, namely, that if the container on which the dispenser is positioned is accidentally pressed, product may be dispensed inadvertently because the various opening-closing valve elements located in the circuit and acting in the same direction are unable to prevent product emerging.

It is also possible for the pressure in the container closed by the dispenser to fall, as in the case of airplane travel or a change in temperature. In those cases, the various opening-closing valve elements located in the circuit and acting in the same direction are unable to prevent product emerging, resulting in contamination of the surroundings.

SUMMARY OF THE INVENTION

The object of the present invention is to remedy this drawback and to this end the present invention relates to a device for dispensing a liquid to pasty product intended to be installed at the open end of a rigid container and consisting of a manual metering pump for delivering a predetermined amount of product to be dispensed, comprising:

- a base element intended to be installed via its lower end on the container by an attachment or adhesion means such as snap engagement or screwing,
- a push button having a dispensing spout mounted telescopically on the upper part of the base element and capable of pump action with respect to the latter, against a return member consisting of
- an elastically deformable bellows for the sealed connection between firstly an internal chamber of the base element, which chamber is open toward the container to allow the product to pass through an opening, and secondly, at its upper end, an internal chamber of the push button into which a hole in the dispensing spout opens, which hole is linked to opening-closing means made at the upper end of said bellows, characterized in that these means consist of:

- a first internal peripheral collar made at the upper end of the bellows, said collar being housed in an internal annular groove in the push button forming a chamber, and bearing against one of the internal walls thereof that it grips elastically with a predetermined force in such a way as to provide a seal or to be lifted radially under a certain pressure of the product when the bellows and the product contained therein are compressed, and thus enable it to be transferred into the annular groove, said first collar being linked to
- a second collar of the bellows, said collar being concentric with the first collar, being housed in the same groove of the push button but bearing against the external wall thereof, into which the orifice of the dispensing spout opens, said second collar being of a height such as not to close off said orifice, the latter being opened or closed by means of a concave locking tongue which is part of the collar and has a height and a width at least sufficient to close off the orifice by pressing against the latter, or to free up the latter during a rotary action, in one direction or the other, on said push button with respect to the base element and as a result with respect to the bellows and to its tongue, which remain stationary.

In this way, according to the desired object, any accidental pressure on the push button in the closed position will stop product emerging, due to the opposition of the locking tongue, the pressing of which against the orifice in the spout will only be increased by the pressure of the product. It is the locking tongue which provides opposition to such leakage.

The invention also relates to the features which will become known in the course of the following description and which should be considered separately or in all their possible technical combinations.

BRIEF DESCRIPTION OF THE DRAWINGS

This description, given by way of nonlimiting example, will make it easier to understand how the invention can be produced by reference to the attached drawings, in which:

FIGS. 12 and 13 are enlarged views of the upper collar part, in the convex position before pumping and in the concave position during the establishment of an overpressure in the bellows part before the collar is opened and the product passes through.

DETAILED DESCRIPTION OF THE PREFERRED EMBODIMENT(S)

Figure 1:
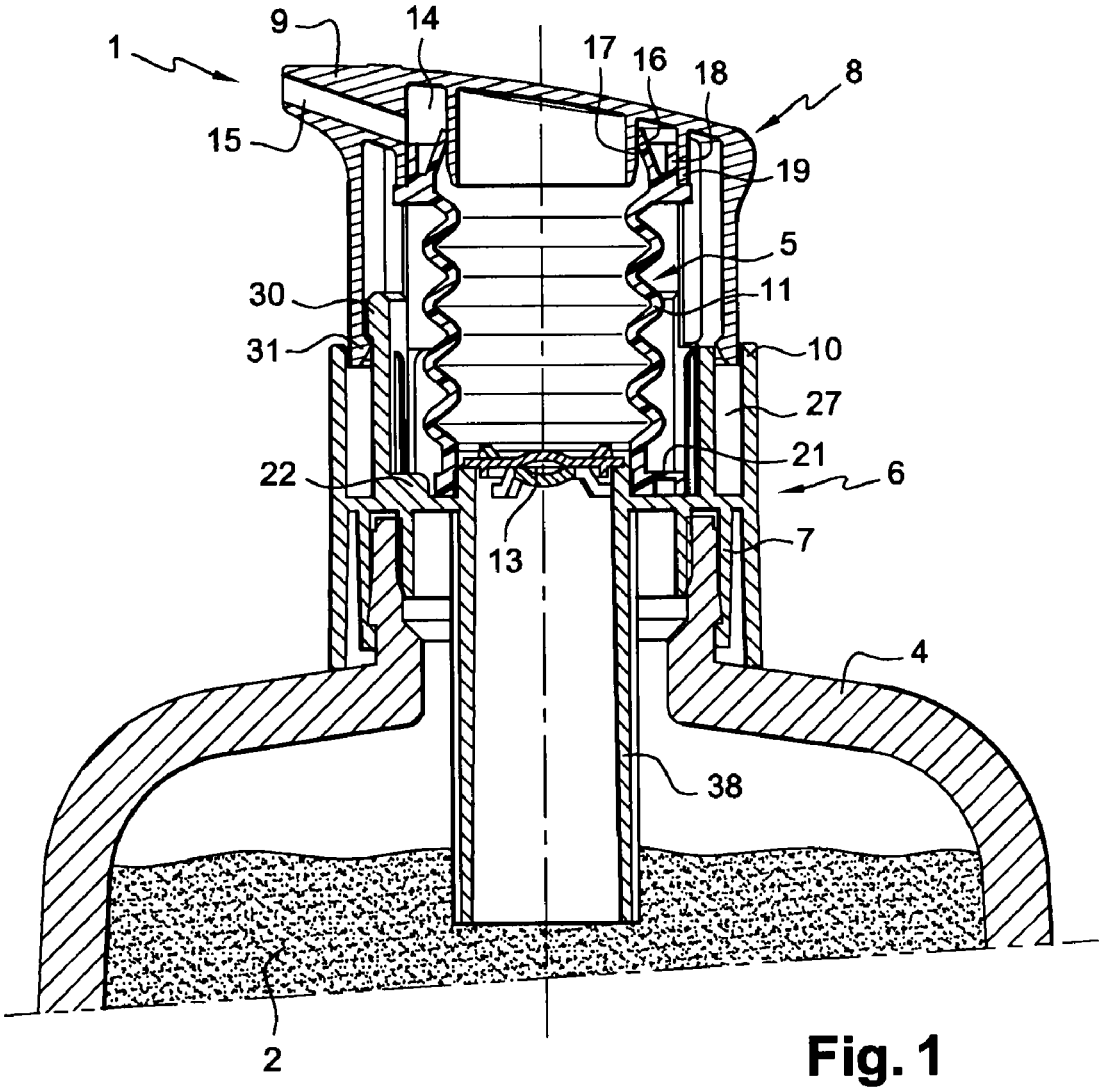
FIG. 1 shows a longitudinal cross-sectional view through a dispensing pump according to the invention, located on a container of a product to be dispensed, the push button being in the open position.
Figure 2:
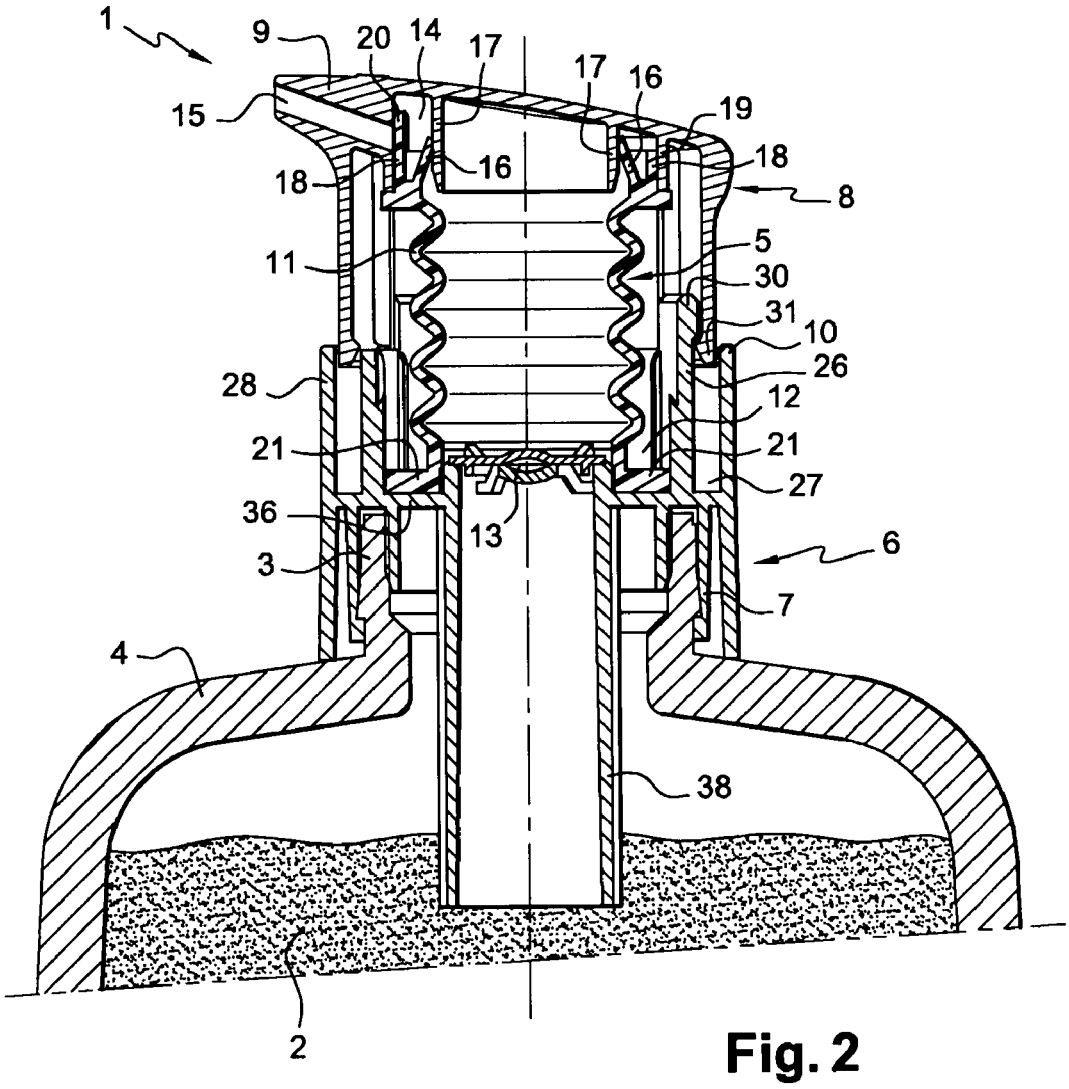
FIG. 2 shows a longitudinal cross-sectional view through a dispensing pump according to the invention, the dispensing spout being in the closed position.
Figure 3:
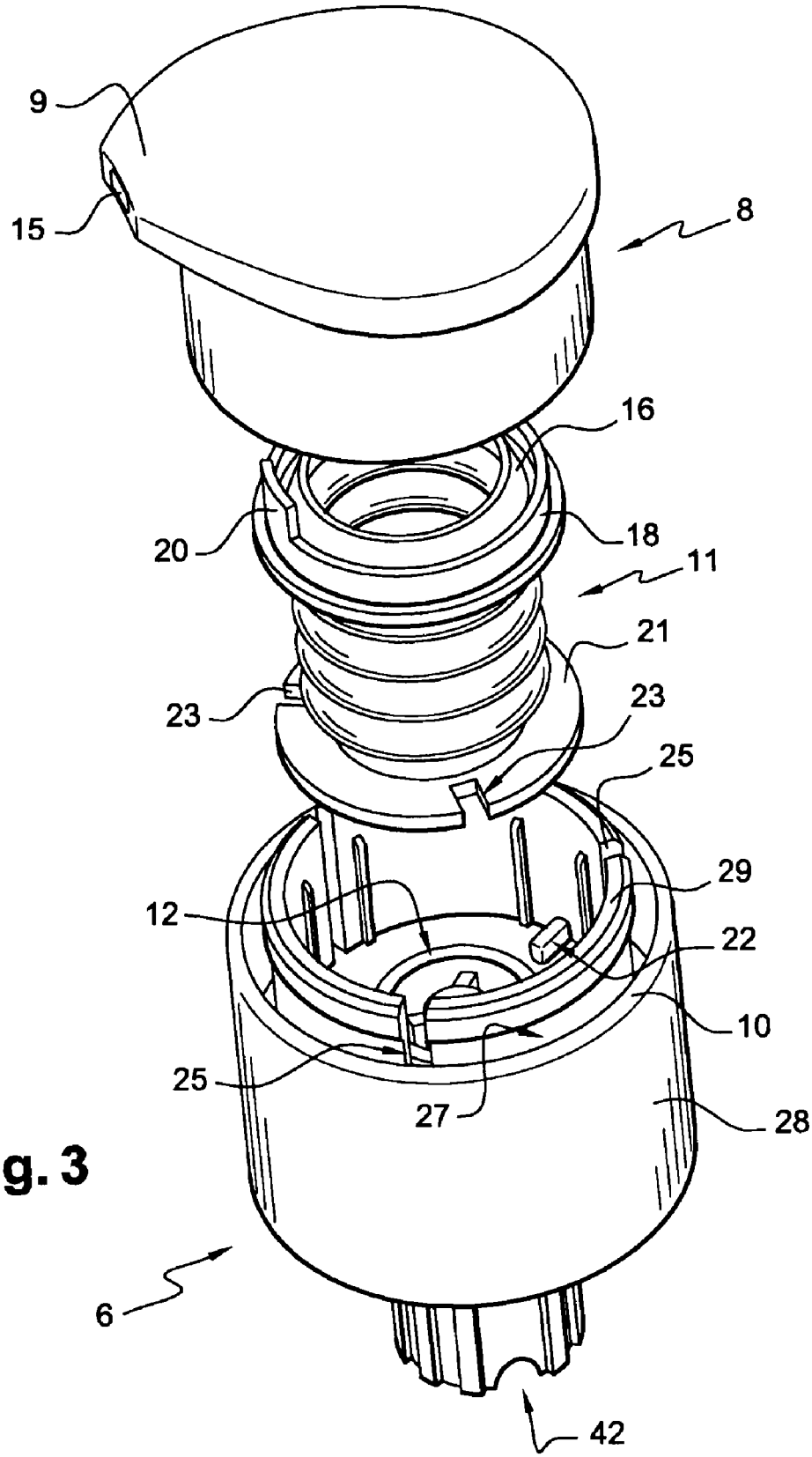
FIG. 3 is a three-quarter exploded perspective view from above of the components of the system according to FIG. 2.
Figure 4:
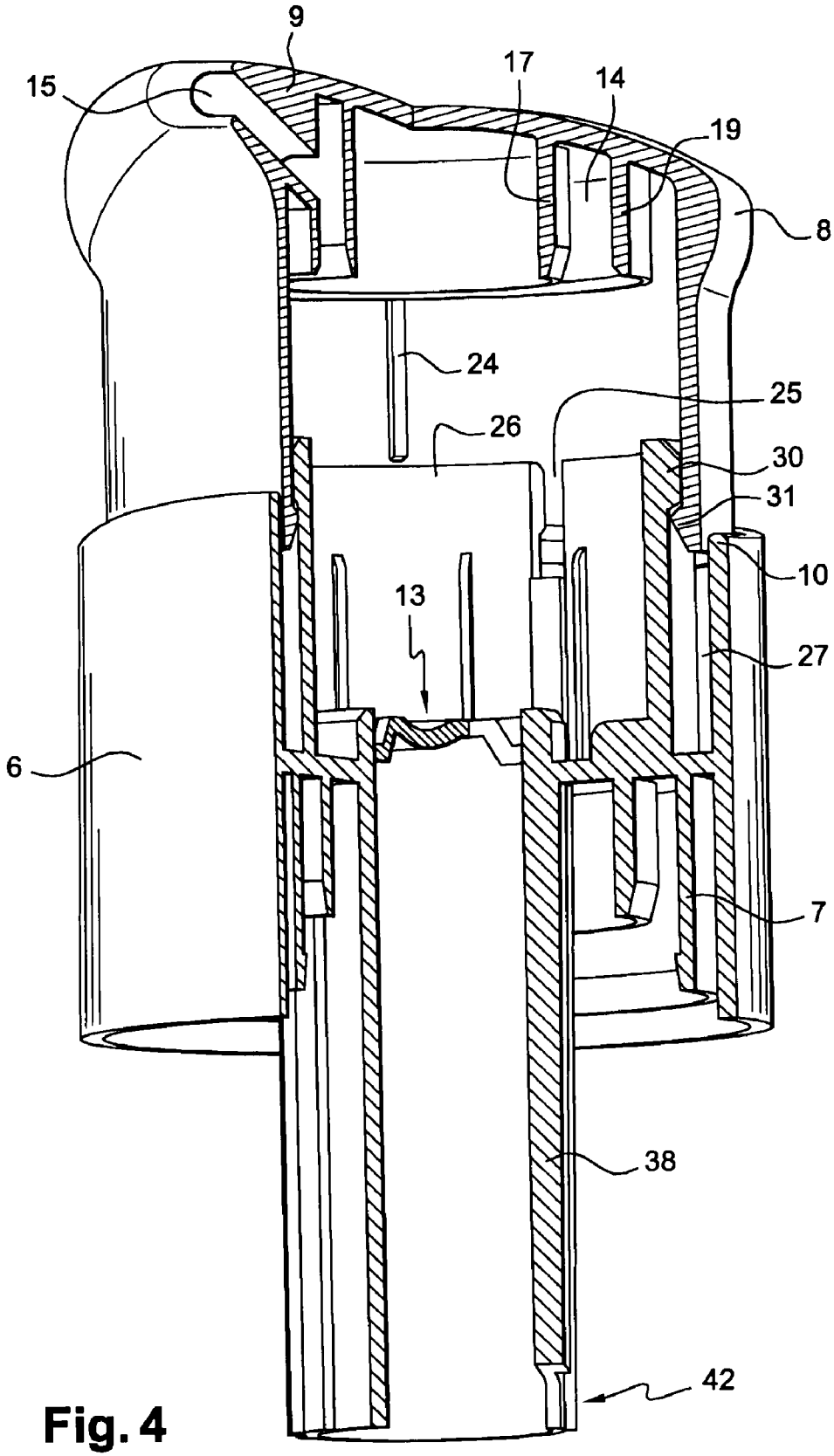
FIG. 4 is a sectional perspective view from the side and in three-quarter section of the push button and the base element in the locked position, the bellows having been removed for ease of understanding.
Figure 5:
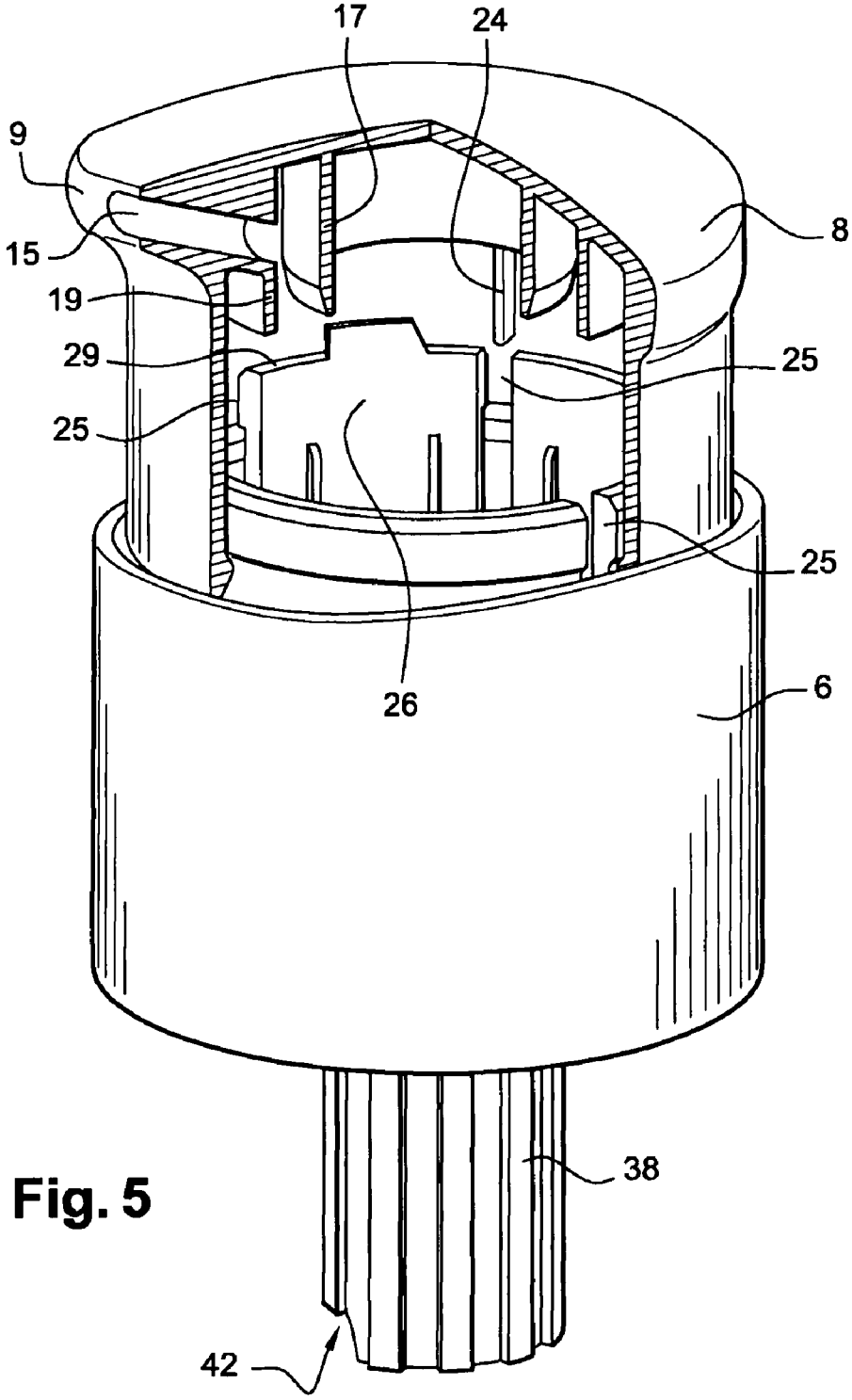
FIG. 5 is a sectional perspective view from the side and in three-quarter section of the push button and the base element in the unlocked position, the bellows having been removed for ease of understanding.
Figure 6:
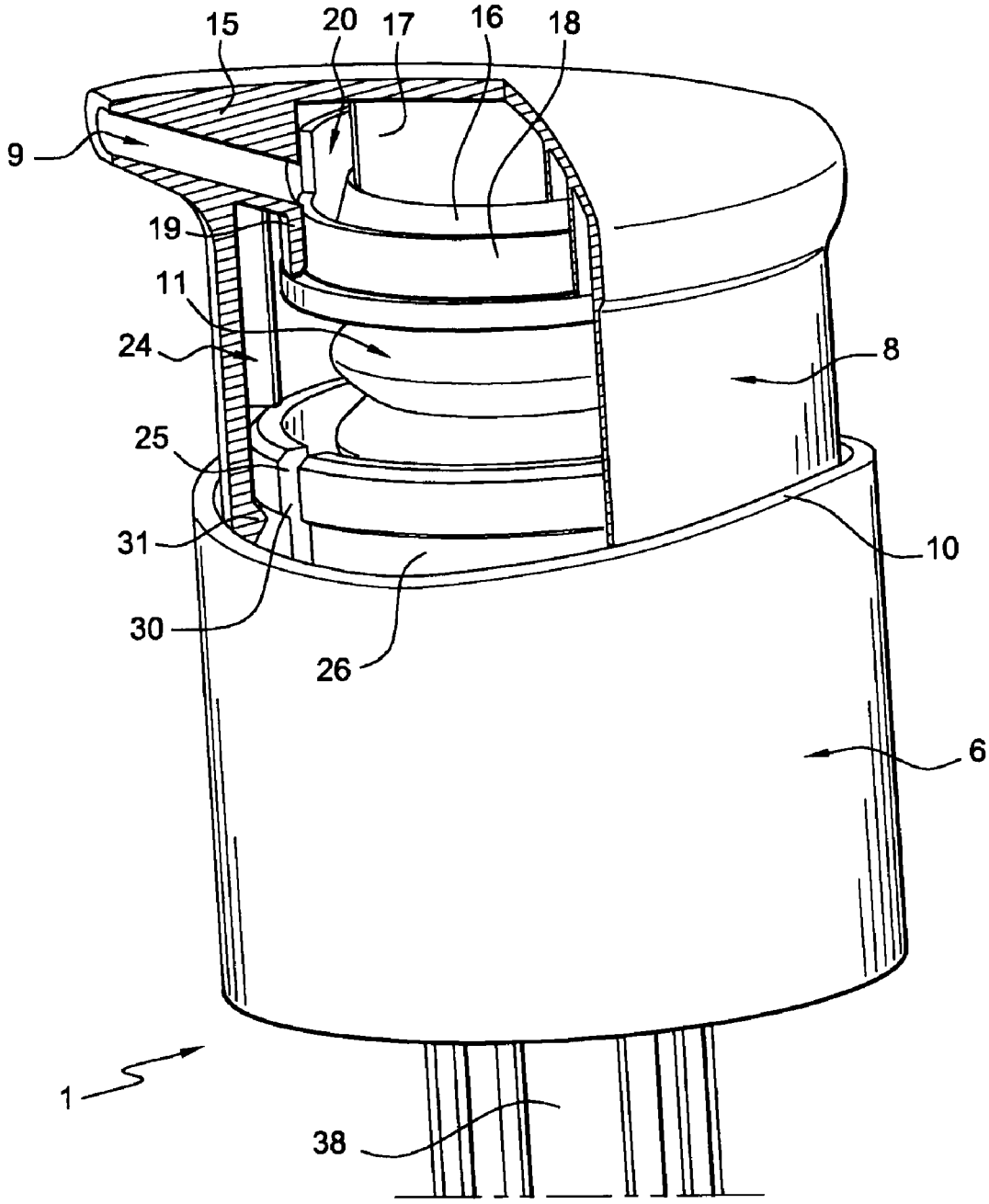
FIG. 6 is a perspective side view, with a cross section through the push button of the dispensing system in the unlocked position, the bellows having been reinserted.
Figure 7:
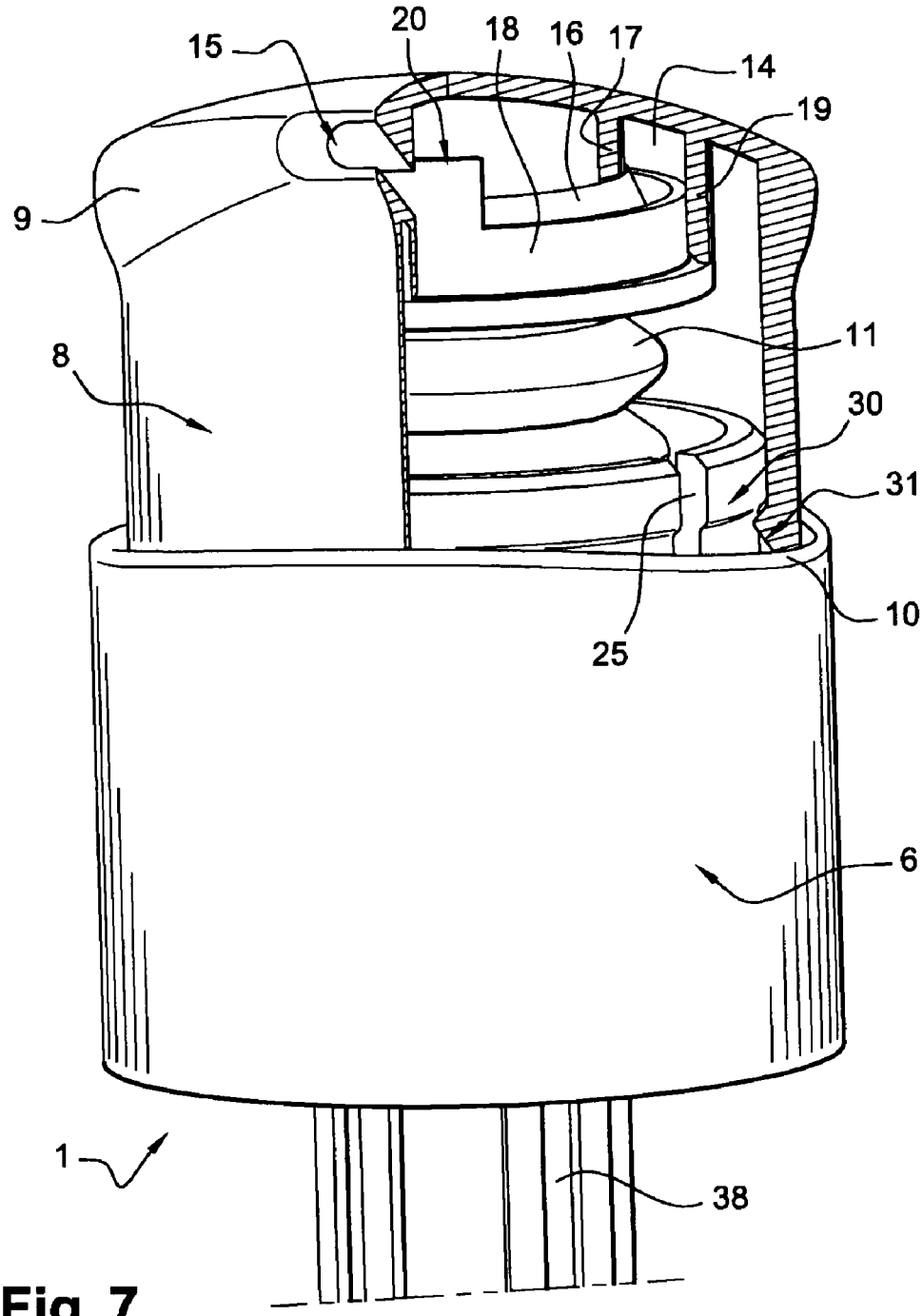
FIG. 7 is a perspective side view, with a cross section through the push button of the dispensing system in the locked position, the bellows having been reinserted.
Figure 8:
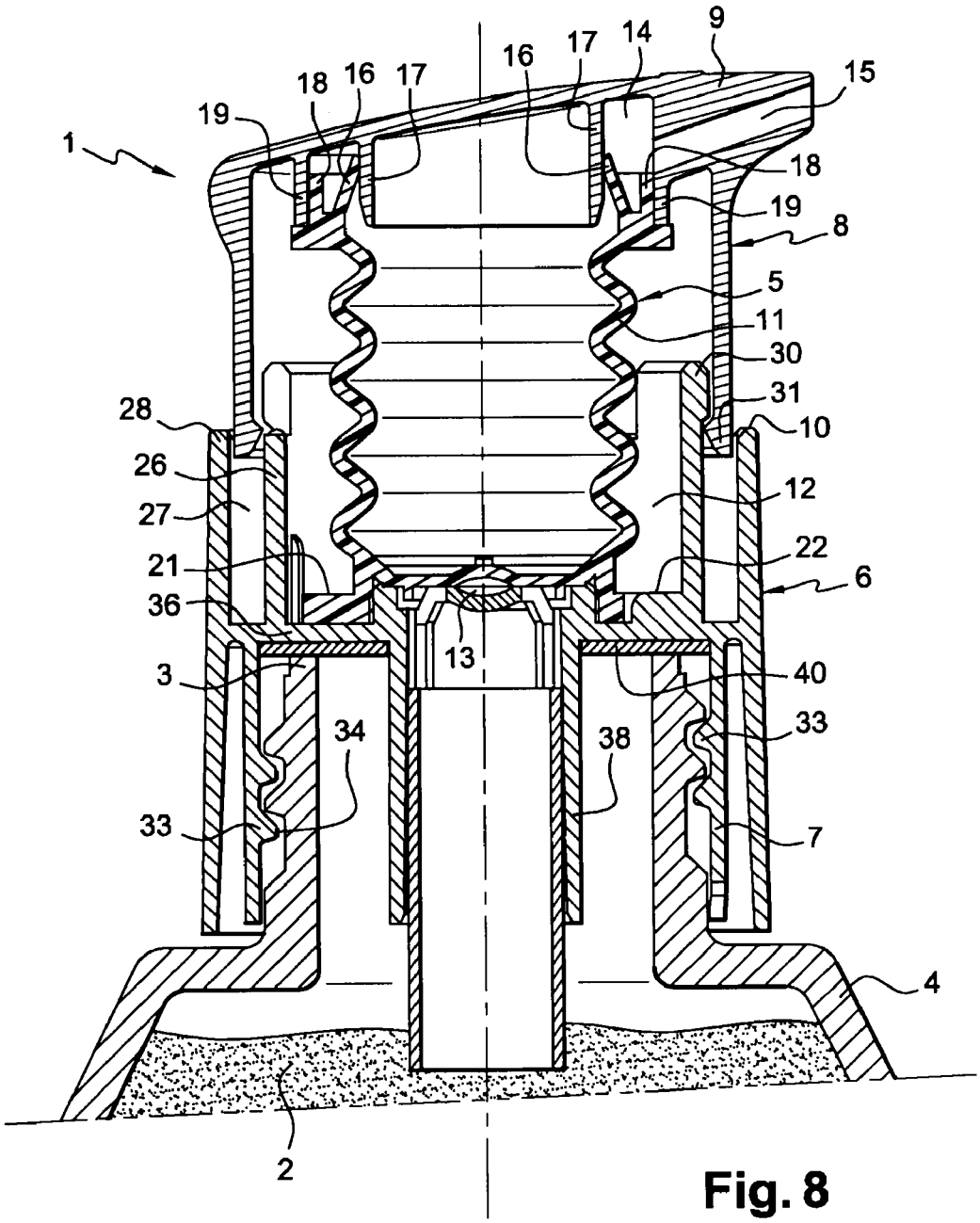
FIG. 8 shows a longitudinal cross-sectional view through a dispensing pump according to another version comprising an air intake, screwed onto a container of a product to be dispensed, the push button being in the open position.
Figure 9:
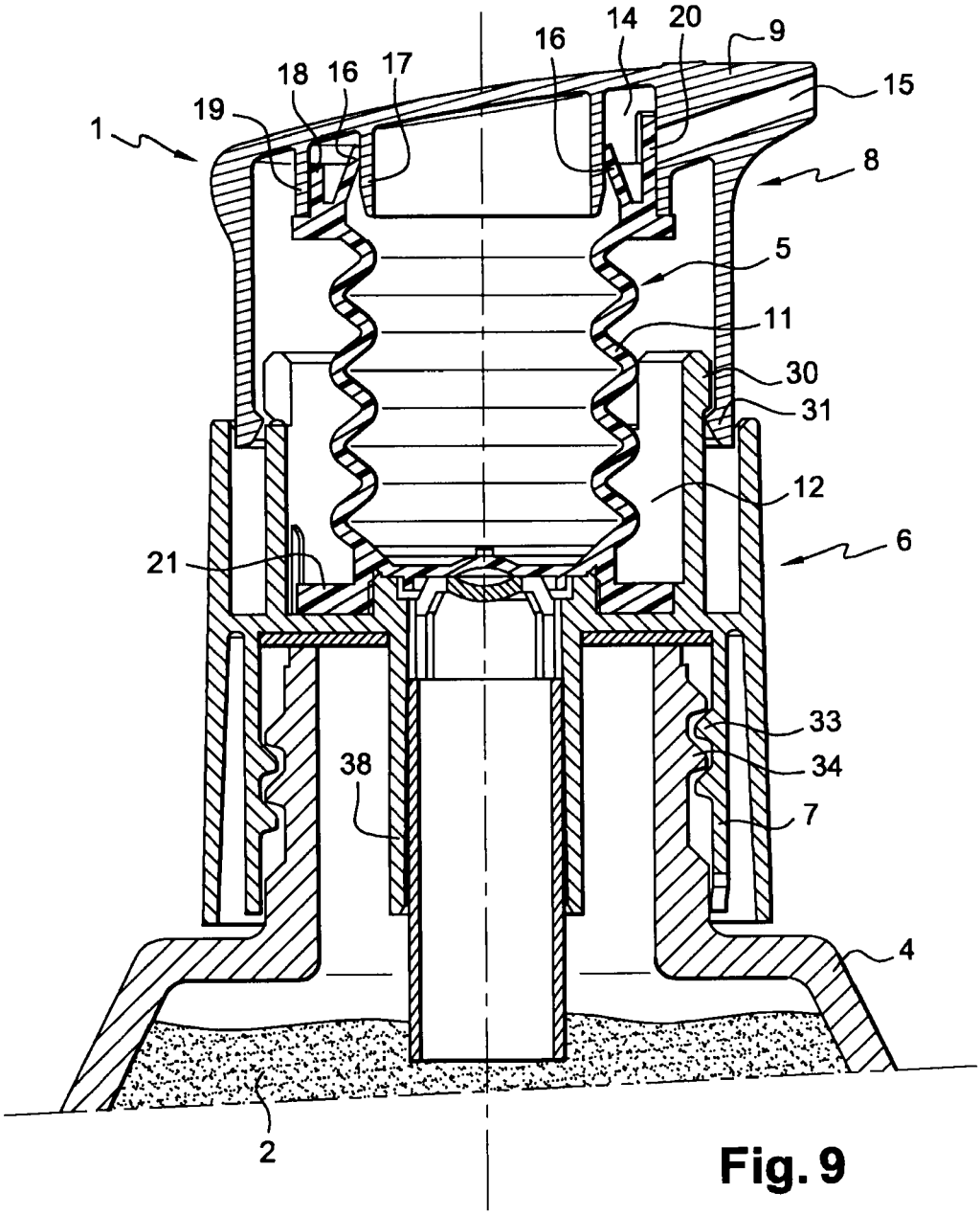
FIG. 9 shows a longitudinal cross-sectional view through a dispensing pump according to another version comprising an air intake, screwed onto a container of a product to be dispensed, the push button being in the closed position.
Figure 10:
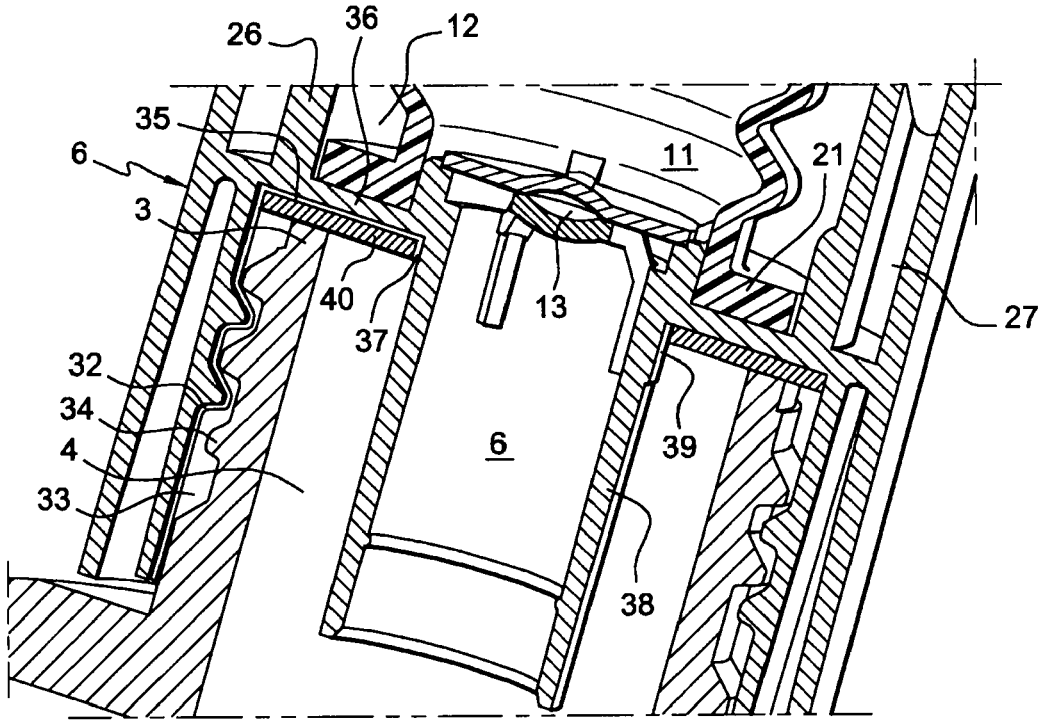
FIG. 10 is longitudinal cross-section view on a larger scale (of the lower part) of a base element on the end of the container, showing the air intake system.
Figure 11:
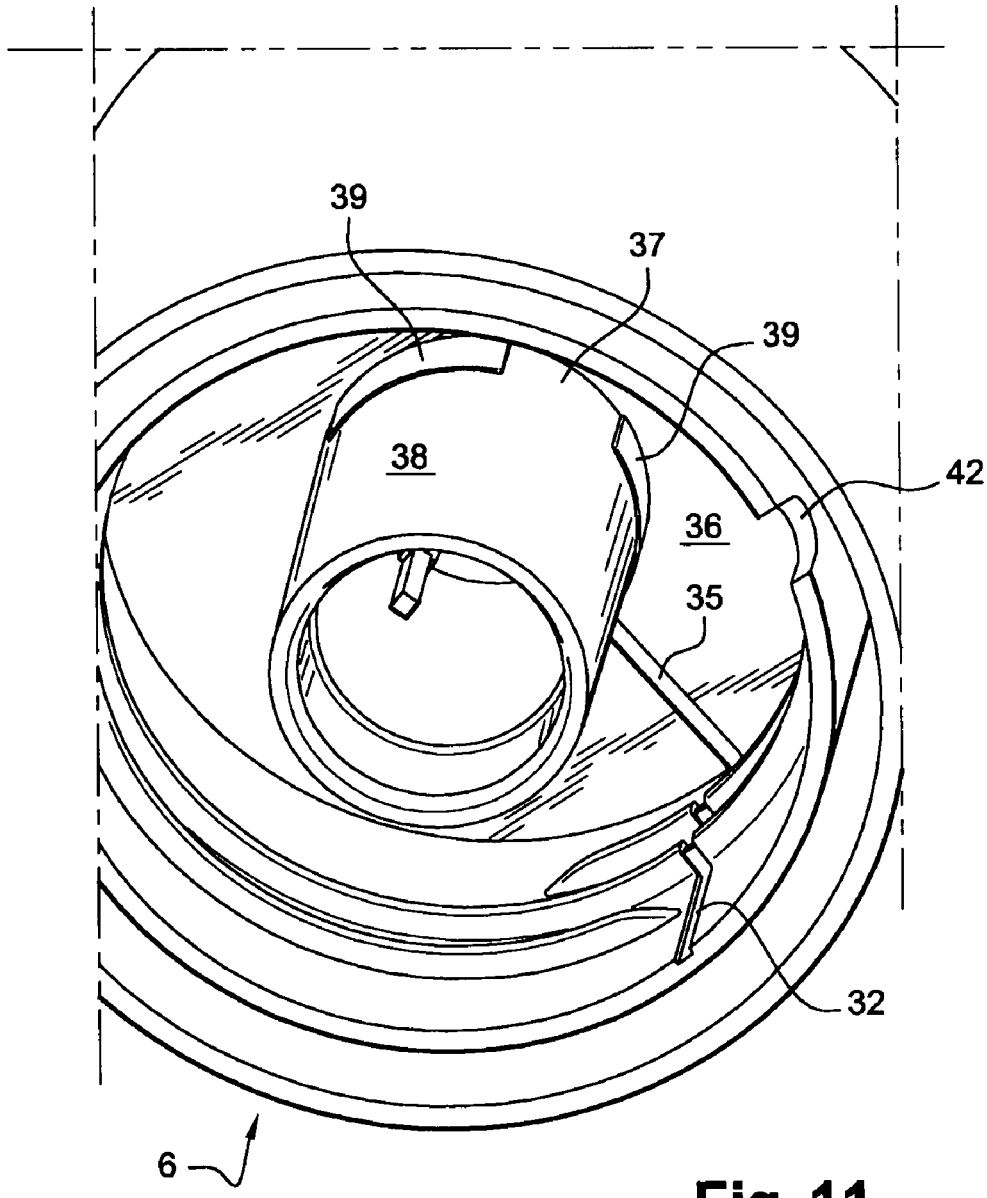
FIG. 11 is a perspective view on a larger scale of the base element seen from beneath, showing the air intake grooves, before the fitting of a seal.

The device indicated 1 as a whole in the figures is intended for the dispensing of a liquid to pasty product 2 when installed on the open end 3 of a rigid container 4 and consists of a manual metering pump 5 for delivering a predetermined amount of product 2 to be dispensed.

In a known manner, the device 1 comprises:

- a base element 6 intended to be installed by an attachment or adhesion means such as snap engagement or screwing onto the container 4 via its lower end 7,
- a push button 8 having a dispensing spout 9 mounted telescopically on the upper part 10 of the base element 6 and capable of pump action with respect to the latter, against a return member consisting of
- an elastically deformable bellows 11 for a sealed connection between firstly an internal chamber 12 of the base element 6, which chamber is open toward the container 4 in order for the product 2 to pass through an opening 13, and secondly, at its upper end, an internal chamber 14 of the push button 8 into which a hole 15 in the dispensing spout 9 opens, which hole is linked to opening-closing means made at the upper end of said bellows 11.

According to the invention, these means consist of:

- a first internal peripheral collar 16 made at the upper end of the bellows 11, said collar being housed in an internal annular groove 14 in the push button 8 forming a chamber, and bearing against one of the internal walls 17 thereof that it grips elastically with a predetermined force in such a way as to provide a seal or to be lifted radially under a certain pressure of the product 2 when it pumps, and thus enable it to be transferred into the annular groove 14, said first collar 16 being linked to
- a second collar 18 of the bellows 11, said collar being concentric with the first collar 16, being housed in the same groove 14 of the push button 8 but bearing against the external wall 19 thereof, into which the orifice 15 of the dispensing spout 9 opens, said second collar 18 being of a height such as not to close off said orifice 15, the latter being opened or closed by means of a concave locking tongue 20 which is part of the collar 18 and has a height and a width at least sufficient to close off the orifice 15 by pressing against the latter, or to free up the latter during a rotary action, in one direction or the other, on said push button 8 with respect to the base element 6 and as a result with respect to the bellows 11 and to its tongue 20, which remain stationary.

In order that the locking tongue 20 is positioned optimally in the locking position, it is necessary for the various components of the pump to be indexed with respect to one another.

For this purpose, the bellows 11 has a base 21 that fits in a sealing manner against the bottom of the internal chamber 12 of the base element 6, and has at least one angular indexing means which is stationary with respect to said base element 6 and as a result with respect to the locking tongue 20 thereof and the push button 8 which, for its part, is able to move.

The indexing means of the bellows consist of at least one radial tooth 22 made on the bottom of the internal chamber 12 of the base element 6 and intended to engage with a corresponding notch 23 in the base 21 of the bellows 11.

According to the present exemplary embodiment, the base 21 of the bellows 11 has three radial indexing notches 23 preventing rotation and forming between each other angles at the center of 120°, 115° and 125°, fitting onto corresponding teeth 22 in the internal chamber 12.

Another means of producing indexing is to position an indent 42 in the tube 38 of the base 6, so as to be able to assemble the bellows 11 by indexing the position of the tab of the bellows 11 with respect to the position of the indent 42 in the base 6. The notches 22 and 23 would, however, be retained to ensure that rotation of the bellows 11 with respect to the base 6 is prevented, but could then have identical angles.

According to another feature of the invention, the push button 8 has means for indexing with respect to the base element 6 and as a result to the bellows 11 and to its spout (9) locking tongue 20, which are stationary with respect to the base element 6.

These indexing means consist firstly of at least one axial rib 24 made on the internal wall of the push button 8 and intended to engage with a corresponding slot 25 in an internal skirt 26 of the base element 6 delimiting the internal chamber 12 thereof, and secondly of a peripheral housing 27 with the external wall 28 of said base element 6, said housing 27 being intended to receive the wall of the push button 8 and to enable said wall both to slide axially and to rotate inside said push button.

This enables the push button 8 to move in the base element 6 in a precisely rectilinear manner and thus limits skewed downward or upward movement owing to the guidance obtained.

According to the present exemplary embodiment, the skirt 26 of the base element 6 has three slots 25 intended to engage with three corresponding axial ribs 24 of the push button 8 in order to constitute the indexing means thereof, each at an angle of 120°.

According to another feature of the invention, the height of the slots 25 in the skirt 26 is firstly less than the height of the latter, owing to sectorial indentations 29 made therein, on the same side of each slot 25, and secondly less than the height of the ribs 24 of the push button 8, such that it can slide axially through a particular stroke into an open position, and thus a product pumping position, or such that it is locked closed in the high position following rotation in the direction of the indentations 29, putting the bottom ends of the ribs 24 of said push button 8 into abutment against the indentations 29 in the skirt 26.

The angle at the center of the sectorial indentations 29 depends on the rotary travel desired.

According to another feature of the invention, the top peripheral end of the internal skirt 26 of the base element 6 and the bottom peripheral end of the wall of the push button 8 have snap-fastening means 30, 31 located in part on the outside of the skirt 26 and in part on the inside of the push button 8 such that the latter can execute an axial stroke and can be rotated when in the top position, while being retained axially on the base element 6.

In this way, the attaching part located on the push button does not in any way hinder the production and downward demolding of the component. For the base element, this makes it possible to conceal the snap-fastening part and to be able to modify the rigidity of the snap engagement by working on the shapes of the discontinuous snap-engaging parts.

Figure 14:
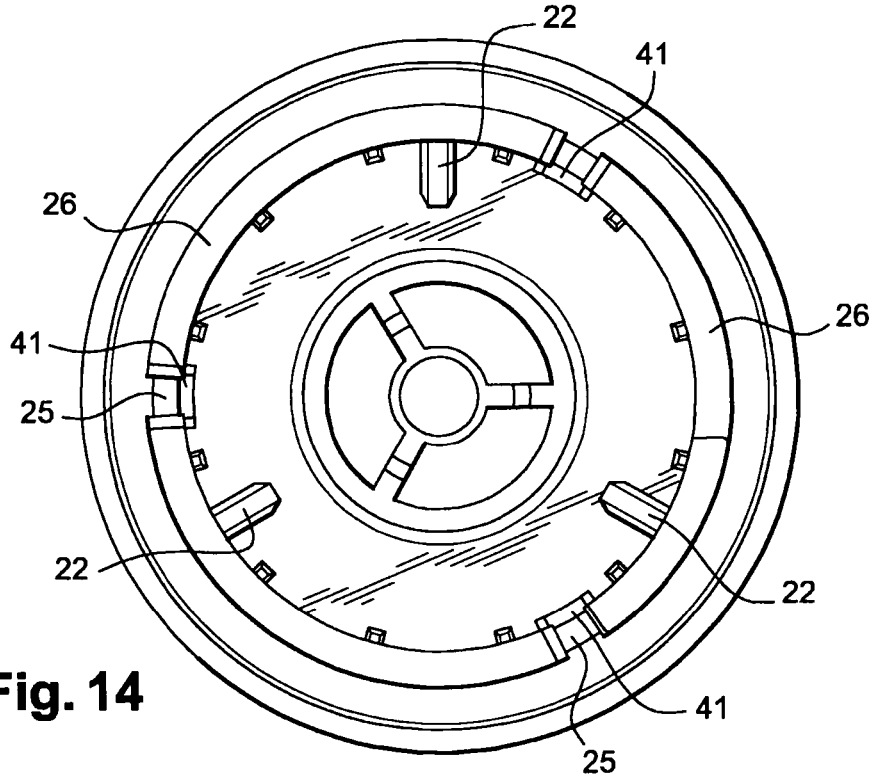
FIG. 14 is a plan view of the base element in a variant embodiment.
Figure 15:
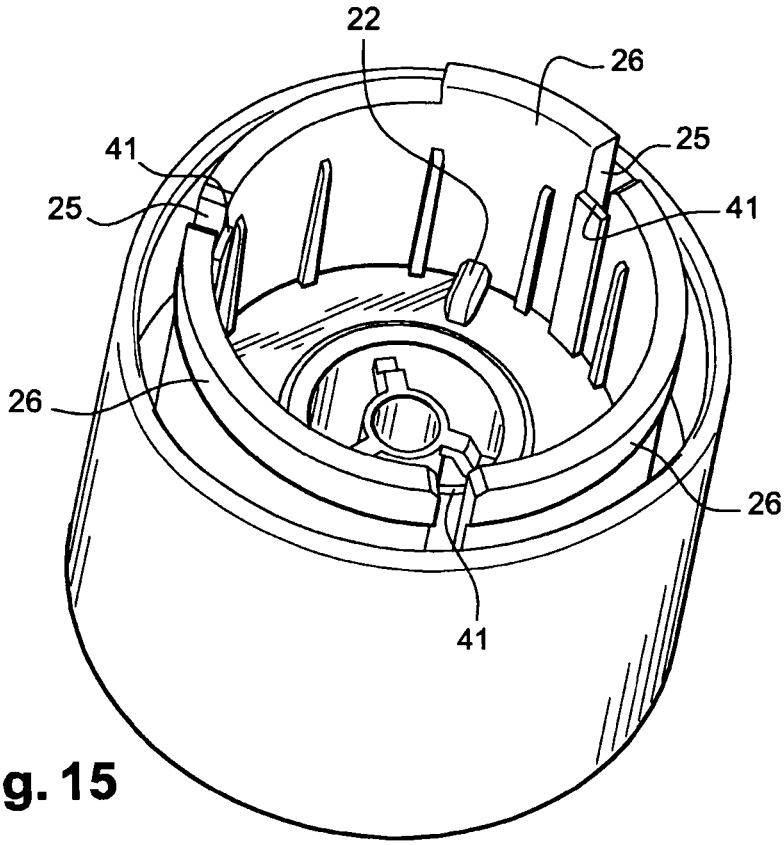
FIG. 15 is a perspective view according to FIG. 14.

According to another embodiment in FIGS. 14 and 15, the rigidity of the snap-engaging parts 26 may be adjusted by positioning a low wall 41 connecting the various parts 26 and by varying the height of said low wall 41.

Figure 12:
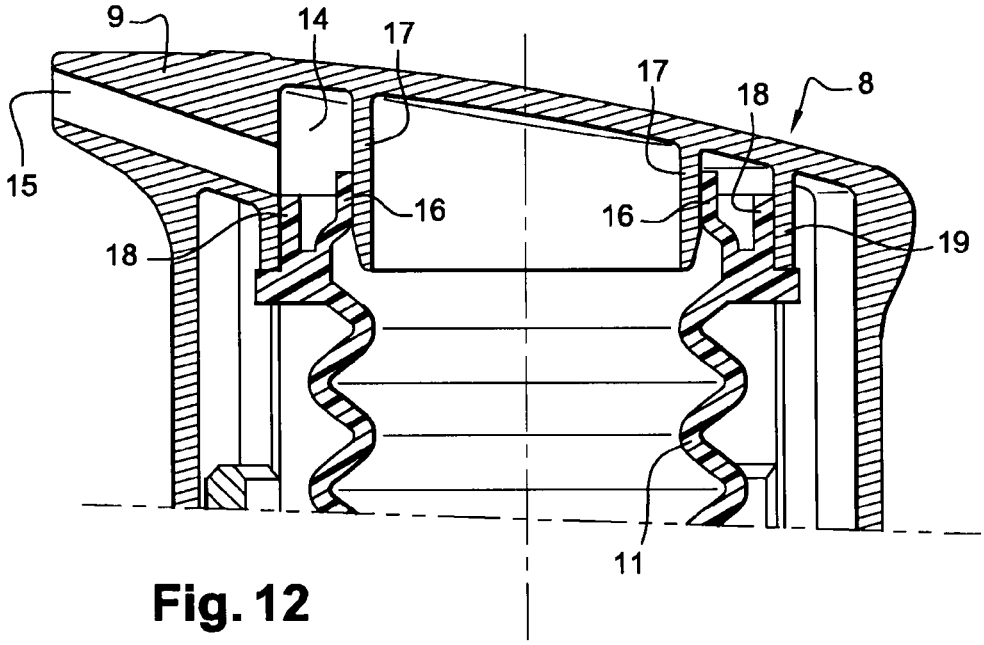
Figure 13:
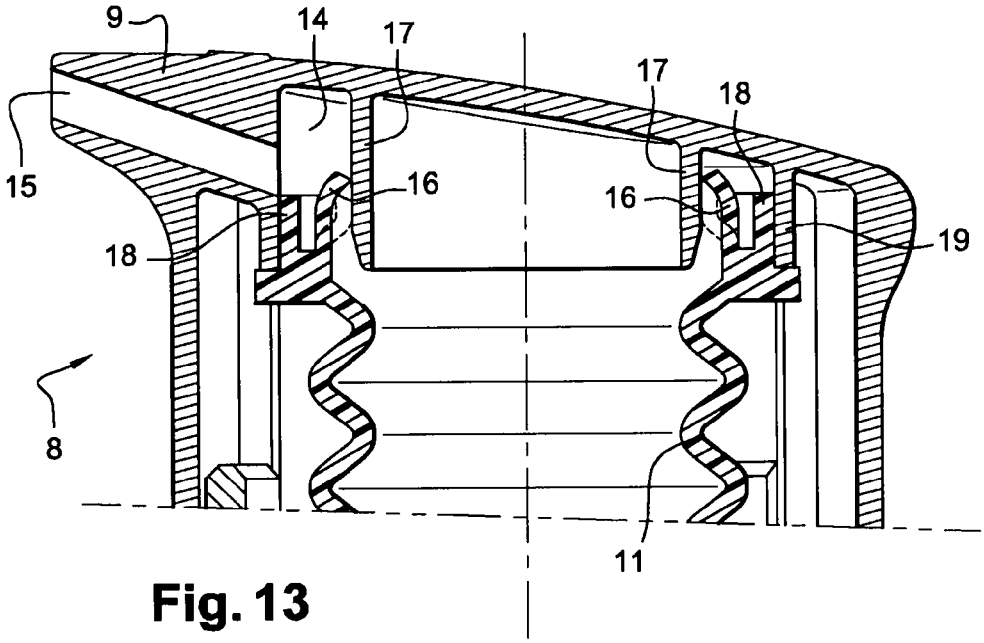

According to another feature of the invention, the first internal peripheral collar 16 of the bellows 11, bearing against the internal wall 17 of the groove 14 in the push button 8, in which groove said bellows is housed, forms a convex geometry with respect to said wall, then a concave geometry before the product 2 passes between said collar 16 and the internal wall 17 of the groove 14 in the push button before emerging through the spout 9 thereof, and then becomes convex again when the positive pressure in the bellows 11 ceases. (See FIGS. 12 and 13).

Specifically, a convex geometry of the collar 16 enables peripheral inflation thereof before it opens and product passes between the wall of said groove and said collar.

This inflation limits the volume between the collar and the dispensing duct of the collar 16 and the orifice 15 of the dispensing spout 9.

The product is then dispensed normally. When the pressure is removed and the product 2 is no longer delivered, the bellows 11 is brought back to its initial position by the effect of its elastic memory. The depression brought about in the bellows 11 due to its return to the initial position brings the collar 16 back from a concave position to a convex position.

This variation in curvature causes a variation in the volume of the space between the collar 16 and the dispensing orifice 15 and in this way even causes the product in this orifice to be sucked back in, avoiding the build-up of a residue at this point giving a dirty impression.

According to another feature of the invention as presented in another version, the device has air intake means consisting of at least one vent consisting of:

- at least one axial groove 32 made on part of the thread 33 of the base element 6 and intended to engage with a thread 34 on the container 4,
- at least one radial groove 35 in communication with the axial groove 32 and made beneath the wall 36 of the chamber 12 of the base element 6,
- axial passages 37 made along generatrices of an axial shaft 38 of the base element 6 extending down into the container 4, said shaft 38 having in its top part, next to the wall of the chamber 12, three bosses 39 disposed peripherally and defining said passages 37 between themselves,
- a deformable seal 40 inserted between the base of the neck 3 of the container 4 and the underneath 36 of the chamber 12 of the base element 6 having the radial groove 35, said seal 40 having an internal diameter approximately equal to that in which the bosses 39 are inscribed, leaving the passages 37 free, and an external diameter such that the axial groove 32 of the thread 33 of the base element 6 is not blocked.

In this way, outside ambient air is taken in without a break, first through the axial groove 32, then the radial groove 35, then the peripheral passages 39, and so into the container 4.

It should be noted that such a vent is large enough for air to pass through in an almost static flow but too narrow to allow liquid to pass through even if it is subjected to high pressure.

In the prior art, it was known to provide an intake of air through an assembly of holes located at the periphery and surmounted by a collar which made it possible for air to enter while preventing the emergence of the product.

The detrimental effect of using a flexible lip is its lack of efficiency in preventing liquid products from leaking through this point.

Moreover, the weakness of this type of lip possibly being made worse by a knock during transport or assembly for example compromises good sealing. Finally, in the case of a pressure increase in the container, due for example to exposure to a heat source, since the product does not force its way through the pump, the pressure may force the product to pass through the air intake hole and to seep through the periphery of the abovementioned sealing lip.

Advantageously, the various components of the system are made of plastic.

Advantageously, the bellows is made of a preferably elastically deformable plastic.

Advantageously, the material of which the bellows is made has the elasticity of rubber and is at the same time able to provide, between the two housing elements, the return forces necessary for pumping. It is for this reason that the choice has been directed toward a plastic sufficiently flexible for a good seal at the collars, sufficiently lively to return to its initial position and provide a depression, and sufficiently creep resistant in order to be able to retain the initial applied forces and to retain repeatability of compression stroke and thus of dose.

Preferably, the bellows is made of injection-moldable polyurethane.

It is likewise possible to use Santoprene (polypropylene-modified ethylene-propylene diene rubber), Hytrel (thermoplastic elastomer ether-ester) or Dryflex (styrene-ethylene-butadiene-styrene styrene thermoplastic), materials which did not exist around twenty years ago, as well as certain types of polyethylenes produced or modified to ensure liveliness and acceptable creep resistance.

The names are trade names and the chemical names thereof are given between parentheses.

These materials have all the features outlined hereinabove.

According to another feature of the invention, a metal or nonmetal spring (not shown) is provided around the bellows 11. The reason for this is that when dispensing very viscous products where the bellows is not strong enough to return to its initial position quickly enough and is unable to bring about a repeatable depression leading to identical doses, a supplementary spring may prove useful for helping it to return to its initial position while retaining sufficient elasticity at the collars.

The invention claimed is:

1. A device for dispensing a liquid to pasty product intended to be installed at an open end of a rigid container and including a manual metering pump for delivering a predetermined amount of said product to be dispensed, comprising:

a base element intended to be installed via a lower end on the container by an attachment means;

a push button having a dispensing spout mounted telescopically on an upper part of the base element and capable of pump action with respect to the base element, against a return member comprising an elastically deformable bellows for a sealed connection between firstly an internal chamber of the base element, which internal chamber is open toward the container in order for the product to pass through an opening, and secondly, at an upper end of said bellows, an internal chamber of the push button into which a hole in the dispensing spout opens, which hole is linked to opening-closing means made at the upper end of said bellows; and said opening-closing means comprising a first internal peripheral collar made at the upper end of the bellows, said collar being housed in an internal annular groove in the push button forming a chamber, and bearing against one internal wall thereof so that said collar grips elastically with a predetermined force in such a way as to provide a seal or to be lifted radially under a certain pressure of the product contained therein when the bellows is compressed, and thus enable the product to be transferred into the annular groove, said first collar being linked to a second collar of the bellows, said second collar being concentric with the first collar, being housed in the annular groove of the push button but bearing against an external wall thereof, into which the hole of the dispensing spout opens, said second collar being of a height such as not to close off said hole, the hole being opened or closed by a concave locking tongue which is part of the second collar and has a height and a width at least sufficient to close off the hole by pressing against the hole, or to free up the hole during a rotary action, in one direction or another, on said push button with respect to the base element and as a result with respect to the bellows and to the locking tongue, which remain stationary.

2. The device as claimed in claim 1, wherein the bellows has a base that fits in a sealing manner against a bottom of the internal chamber of the base element, and has at least one angular indexing means which is stationary with respect to said base element and as a result with respect to the locking tongue thereof and the push button which is able to move.

3. The device as claimed in claim 2, wherein the indexing means of the bellows has at least one radial tooth made on the bottom of the internal chamber of the base element and intended to engage with a corresponding notch in a base of the bellows.

4. The device as claimed in claim 3, wherein the base of the bellows has three radial indexing notches preventing rotation and forming between each other angles at the center of 120°, 115° and 125°, fitting onto corresponding teeth in the internal chamber.

5. The device as claimed in claim 3, wherein the base element of the device has an indent on a bottom part of the base element for indexing the base element with respect to the locking tongue of the bellows.

6. The device as claimed in claim 1, wherein the push button has means for indexing with respect to the base element and as a result to the bellows and to said spout and said locking tongue which are stationary with respect to the base element.

7. The device as claimed in claim 6, wherein said indexing means comprises at least one axial rib made on the internal wall of the push button and intended to engage with a corresponding slot in an internal skirt of the base element delimiting the internal chamber thereof, and a peripheral housing with an external wall of said base element, said housing being intended to receive the internal wall of the push button and to enable said internal wall both to slide axially and to rotate inside said push button.

8. The device as claimed in claim 7, wherein the internal skirt of the base element has three slots intended to engage with three corresponding axial ribs of the push button in order to constitute the indexing means thereof, each at an angle of 120°.

9. The device as claimed in claim 8, wherein the height of the slots in the internal skirt is less than the height of the internal skirt, owing to sectorial indentations made therein, on the same side of each slot, and less than the height of the ribs of the push button, such that the push button can slide axially through a particular stroke into an open position, and thus a product pumping position, or such that said push button is locked closed in a high position following rotation in the direction of the indentations, putting bottom ends of the ribs of said push button into abutment against the indentations in the internal skirt.

10. The device as claimed in claim 9, wherein a top peripheral end of the internal skirt of the base element and a bottom peripheral end of the wall of the push button have snap-fastening means located in part on an outside of the internal skirt and in part on an inside of the push button such that the push button can execute an axial stroke and can be rotated when in the top position, while being retained axially on the base element.

11. The device as claimed in claim 1, wherein the first internal peripheral collar of the bellows, bearing against an internal wall of the groove in the push button, in which groove said bellows is housed, forms a convex geometry with respect to said internal wall, then a concave geometry before the product passes between said first collar and the internal wall of the groove in the push button before emerging through the spout thereof, and then becomes convex again when a positive pressure in the bellows ceases.

12. The device as claimed in claim 1, wherein said device has air intake means comprising of at least one vent comprising at least one axial groove made on part of a thread of the base element and intended to engage with a thread on the container, at least one radial groove in communication with the at least one axial groove and made beneath a wall of the internal chamber of the base element, axial passages made along generatrices of an axial shaft of the base element extending down into the container, said axial shaft having in a top part, next to the wall of the internal chamber, three bosses disposed peripherally and defining said passages between themselves, a deformable seal inserted between a base of a neck of the container and an underneath of the internal chamber of the base element having the at least one radial groove, said deformable seal having an internal diameter approximately equal to that in which the bosses are inscribed, leaving the passages free, and an external diameter such that the at least one axial groove of the thread of the base element is not blocked, such that outside ambient air is taken in without a break, first through the at least one axial groove, then the at least one radial groove, then the peripheral passages, and so into the container.

13. The device as claimed in claim 1, wherein the pump has constituent components made of plastic.

14. The device as claimed in claim 13, wherein the bellows is made of an elastically deformable plastic.

15. The device as claimed in claim 14, wherein the bellows is made of injection-moldable polyurethane.

16. The device as claimed in claim 14, wherein the bellows is made of a polypropylene-modified ethylene-propylene diene rubber.

17. The device as claimed in claim 14, wherein the bellows is made of a thermoplastic elastomer ether-ester.

18. The device as claimed in claim 14, wherein the bellows is made of a styrene-ethylene-butadiene-styrene styrene thermoplastic.

19. The device as claimed in claim 14, wherein the bellows is made of polyethylenes produced or modified to ensure liveliness and acceptable creep resistance.

20. The device as claimed in claim 1, further comprising a supplementary spring provided around the bellows.

* * * * *